US008622658B2

(12) United States Patent
Reinhall et al.

(10) Patent No.: US 8,622,658 B2
(45) Date of Patent: Jan. 7, 2014

(54) PILE TO MINIMIZE NOISE TRANSMISSION AND METHOD OF PILE DRIVING

(75) Inventors: Per G. Reinhall, Seattle, WA (US); Peter H. Dahl, Seattle, WA (US)

(73) Assignee: University of Washington through its Center for Commercialization, Seattle, WA (US)

( * ) Notice: Subject to any disclaimer, the term of this patent is extended or adjusted under 35 U.S.C. 154(b) by 0 days.

(21) Appl. No.: 13/574,231

(22) PCT Filed: Jan. 19, 2011

(86) PCT No.: PCT/US2011/021723

§ 371 (c)(1),
(2), (4) Date: Jul. 19, 2012

(87) PCT Pub. No.: WO2011/091041

PCT Pub. Date: Jul. 28, 2011

(65) Prior Publication Data

US 2013/0011203 A1 Jan. 10, 2013

Related U.S. Application Data

(60) Provisional application No. 61/296,413, filed on Jan. 19, 2010.

(51) Int. Cl.
*E02D 11/00* (2006.01)

(52) U.S. Cl.
USPC ..... 405/228; 405/232

(58) Field of Classification Search
USPC ..... 405/227, 228, 231, 232, 255, 256, 257
See application file for complete search history.

(56) References Cited

U.S. PATENT DOCUMENTS

| | | | | |
|---|---|---|---|---|
| 2,972,871 | A * | 2/1961 | Foley, Jr. | 405/245 |
| 4,808,037 | A * | 2/1989 | Wade et al. | 405/226 |
| 4,817,734 | A * | 4/1989 | Kuehn | 173/29 |
| 5,282,701 | A * | 2/1994 | An et al. | 405/245 |
| 6,042,304 | A * | 3/2000 | Manning | 405/255 |
| 6,354,766 | B1 | 3/2002 | Fox | |

FOREIGN PATENT DOCUMENTS

| | | |
|---|---|---|
| KR | 10-0543727 B1 | 1/2006 |
| KR | 10-0657176 B1 | 12/2006 |
| KR | 10-0841735 B1 | 6/2008 |
| WO | 2004053237 A1 | 6/2004 |

OTHER PUBLICATIONS

International Search Report and Written Opinion mailed Aug. 3, 2011, issued in corresponding International Application No. PCT/US2011/021723, filed Jan. 19, 2011, 7 pages.

* cited by examiner

*Primary Examiner* — Tara M. Pinnock
(74) *Attorney, Agent, or Firm* — Christensen O'Connor Johnson Kindness PLLC

(57) ABSTRACT

A pile and method for driving a pile includes a pile having a structural outer tube, and an inner member disposed generally concentrically with the outer tube. The outer tube and inner member are fixed to a driving shoe. The pile is constructed and driven such that the pile driver impacts only the inner member. The impact loads are transmitted to the driving shoe to drive the pile into the sediment, such that the outer tube is thereby pulled into the sediment. In a particular embodiment the outer tube is formed of steel, and the inner member also comprises a steel tube. In an alternative embodiment one or both of the inner member and the outer tube are formed of an alternative material, for example, concrete. In an embodiment, the outer tube has a recess that captures a flange on the inner member. In an embodiment the outer tube is attached to the inner member with an elastic spring.

23 Claims, 6 Drawing Sheets

PILE TO MINIMIZE NOISE TRANSMISSION AND METHOD OF PILE DRIVING

CROSS-REFERENCE TO RELATED APPLICATION

This application claims the benefit of Provisional Application No. 61/296,413, filed Jan. 19, 2010, the entire disclosure of which is hereby incorporated by reference herein.

BACKGROUND

Pile driving in water produces extremely high sound levels in the surrounding environment in air and underwater. For example, underwater sound levels as high as 220 dB re 1 μPa are not uncommon ten meters away from a steel pile as it is driven into the sediment with an impact hammer.

Reported impacts on wildlife around a construction site include fish mortality associated with barotrauma, hearing impacts in both fish and marine mammals, and bird habitat disturbance. Pile driving in water is therefore a highly regulated construction process and can only be undertaken at certain time periods during the year. The regulations are now strict enough that they can severely delay or prevent major construction projects.

There is thus significant interest in reducing underwater noise from pile driving either by attenuating the radiated noise or by decreasing noise radiation from the pile. As a first step in this process it is necessary to understand the dynamics of the pile and the coupling with the water as the pile is driven into sediment. The process is a highly transient one in that every strike of the pile driving hammer on the pile causes the propagation of deformation waves down the pile. To gain an understanding of the sound generating mechanism the present inventors have conducted a detailed transient wave propagation analysis of a submerged pile using finite element techniques. The conclusions drawn from the simulation are largely verified by a comparison with measured data obtained during a full scale pile driving test carried out by the University of Washington, the Washington State Dept. of Transportation, and Washington State Ferries at the Vashon Island ferry terminal in November 2009. Prior art efforts to mitigate the propagation of dangerous sound pressure levels in water from pile driving have included the installation of sound abatement structures in the water surrounding the piles. For example, in *Underwater Sound Levels Associated With Pile Driving During the Anacortes Ferry Terminal Dolphin Replacement Project*, Tim Sexton, Underwater Noise Technical Report, Apr. 9, 2007 ("Sexton"), a test of sound abatement using bubble curtains to surround the pile during installation is discussed. A bubble curtain is a system that produced bubbles in a deliberate arrangement in water. For example, a hoop-shaped perforated tube may be provided on the seabed surrounding the pile, and provided with a pressurized air source, to release air bubbles near or at the sediment surface to produce a rising sheet of bubbles that act as a barrier in the water. Although significant sound level reductions were achieved, the pile driving operation still produced high sound levels.

Another method for mitigating noise levels from pile driving is described in a master's thesis by D. Zhou titled *Investigation of the Performance of a Method to Reduce Pile Driving Generated Underwater Noise* (University of Washington, 2009). Zhou describes and models a noise mitigation apparatus dubbed Temporary Noise Attenuation Pile (TNAP) wherein a steel pipe is placed about a pile before driving the pile into place. The TNAP is hollow-walled and extends from the seabed to above the water surface. In a particular apparatus disclosed in Zhou the TNAP pipe is placed about a pile having a 36-inch outside diameter. The TNAP pipe has an inner wall with a 48-inch O.D., and an outer wall with a 54-inch O.D. A 2-inch annular air gap separates the inner wall from the outer wall.

Although the TNAP did reduce the sound levels transmitted through the water, not all criteria for noise reduction were achieved.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A pile is disclosed that includes an inner member, for example, a steel tube or a concrete rod, and an outer tube, for example, a steel tube. A driving shoe, which may be formed integrally with the inner member and outer tube, connects proximal end portions of the inner member and outer tube. The pile is configured to be driven into the ground or sediment by impacting the inner member, without impacting the outer tube, and such that the entire pile is driven into the sediment. For example, the inner member may extend upwardly away from the upper end of the outer tube. The radial expansion wave generated by the impact of the pile driver on the inner tube is therefore substantially shielded from the water.

In an embodiment, a compliant annular material, for example, a polymeric foam, is disposed in an annular space between the inner member and the outer tube and located near the upper end of the outer tube.

In an embodiment, the inner member further has an outer flange and the outer tube has an annular recess on its inside diameter that is configured to capture the outer flange of the inner member.

In an embodiment the inner member is attached to the outer tube with an annular elastic spring member.

A method for driving piles into a seabed is also disclosed, including: providing a pile having a driving shoe, an inner member attached to the driving shoe and extending upwardly from the driving shoe, and an outer tube attached to the driving shoe and extending upwardly from the driving shoe; positioning the pile at a desired position with the driving shoe contacting the seabed; and driving the pile with a pile driver such that the pile driver impacts the inner member without impacting the outer tube such that the outer tube is pulled into the sediment by the driving shoe.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1A:
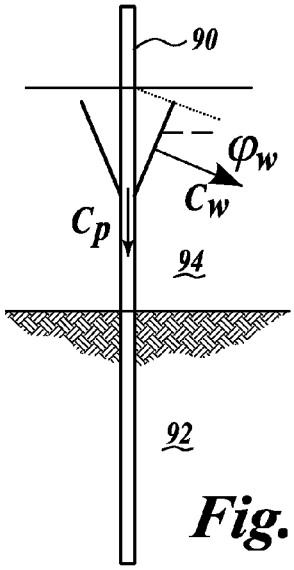
FIGS. 1A-1D illustrate the primary wave fronts associated with the Mach cone generated by a representative pile compression wave.

To investigate the acoustic radiation due to a pile strike we created an axisymmetric finite element model of a 30-inch radius, 32 m long hollow steel pile with a wall thickness of one inch submerged in 12.5 m of water and driven 14 m into the sediment. The radius of the water and sediment domain was 10 m. Perfectly matched boundary conditions were used to prevent reflections from the boundaries that truncate the water and sediment domains. The pile was fluid loaded via interaction between the water/sediment. All domains were meshed using quadratic Lagrange elements.

The pile was impacted with a pile hammer with a mass of 6,200 kg that was raised to a height of 2.9 m above the top of the pile. The velocity at impact was 7.5 m/s, and the impact pressure as a function of time after impact was examined using finite element analysis and approximated as:

$$P(t)=2.7*10^8\exp(-t/0.004)\text{Pa} \quad (1)$$

The acoustic medium was modeled as a fluid using measured water sound speed at the test site, $c_w$, and estimated sediment sound speed, $c_s$, of 1485 m/s and 1625 m/s, respectfully. The sediment speed was estimated using coring data metrics obtained at the site, which is characterized by fine sand, and applied to empirical equations.

The present inventors conducted experiments to measure underwater noise from pile driving at the Washington State Ferries terminal at Vashon Island, Wash., during a regular construction project. The piles were approximately 32 m long and were set in 10.5 to 12.5 m of water depending on tidal range. The underwater sound was monitored using a vertical line array consisting of nine hydrophones with vertical spacing of 0.7 m, and the lowest hydrophone placed 2 m from the bottom. The array was set such that the distance from the piles ranged from 8 to 12 m.

Pressure time series recorded by two hydrophones located about 8 m from the pile showed the following key features:

1. The first and highest amplitude arrival is a negative pressure wave of order 10–100 kPa;

2. The main pulse duration is ~20 ms over which there are fluctuations of 10 dB; during the next 40 ms the level is reduced by 20 dB; and 3. There are clearly observable time lags between measurements made at different heights off the bottom. These time lags can be associated with the vertical arrival angle.

The finite element analysis shows that the generation of underwater noise during pile driving is due to a radial expansion wave that propagates along the pile after impact. This structural wave produces a Mach cone in the water and the sediment. An upward moving Mach cone produced in the sediment after the first reflection of the structural wave results in a wave front that is transmitted into the water. The repeated reflections of the structural wave cause upward and downward moving Mach cones in the water. The corresponding acoustic field consists of wave fronts with alternating positive and negative angles. Good agreement was obtained between a finite element wave propagation model and measurements taken during full scale pile driving in terms of angle of arrival. Furthermore, this angle appears insensitive to range for the 8 to 12 m ranges measured, which is consistent with the wave front being akin to a plane wave.

Figure 1B:
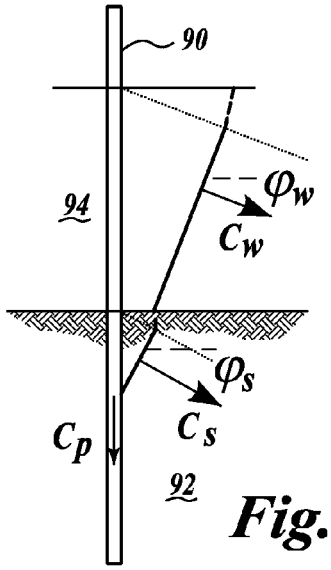

The primary source of underwater sound originating from pile driving is associated with compression of the pile. Refer to FIGS. 1A-1D, which illustrate schematically the transient behavior of the reactions associated with an impact of a pile driver (not shown) with a pile 100. In FIG. 1A, the compression wave in the pile due to the hammer strike produces an associated radial displacement motion due to the effect of Poisson's ratio of steel (0.33). This radial displacement in the pile propagates downwards (indicated by downward arrow) with the longitudinal wave with wave speed of $c_p$=4,840 m/s when the pile 100 is surrounded by water 94. Since the wave speed of this radial displacement wave is higher than the speed of sound in the water 94 the rapidly downward propagating wave produces an acoustic field in the water 94 in the shape of an axisymmetric cone with apex traveling along with the pile deformation wave front. This Mach cone is formed with cone angle of $\phi_w=\sin^{-1}(c_w/c_p)=17.9°$. Note that this is the angle formed between the vertically oriented pile 100 and the wave front associated with the Mach cone; it is measured with a vertical line array, and here it will be manifested as a vertical arrival angle with reference to horizontal. This angle only depends on the two wave speeds and is independent of the distance from the pile. As illustrated in FIG. 1B, the Mach cone angle changes from $\phi_w$ to $\phi_s=\sin^{-1}(c_w/c_p)=19.7°$ as the pile bulge wave enters sediment 92. Note that the pile bulge wave speed in the sediment 92 is slightly lower due to the higher mass loading of the sediment 92 and is equal to $c_p$=4,815 m/s.

Figure 1C:
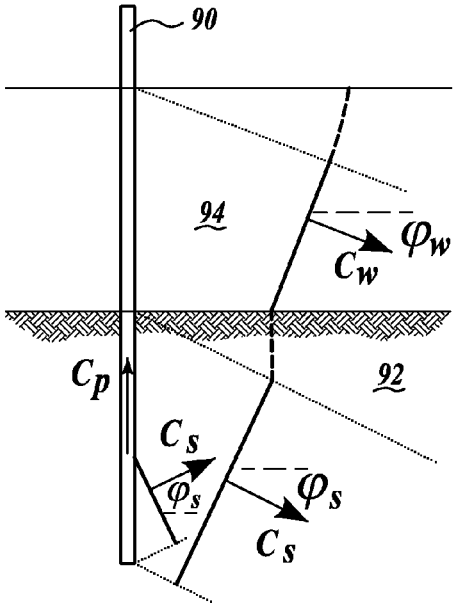
Figure 1D:
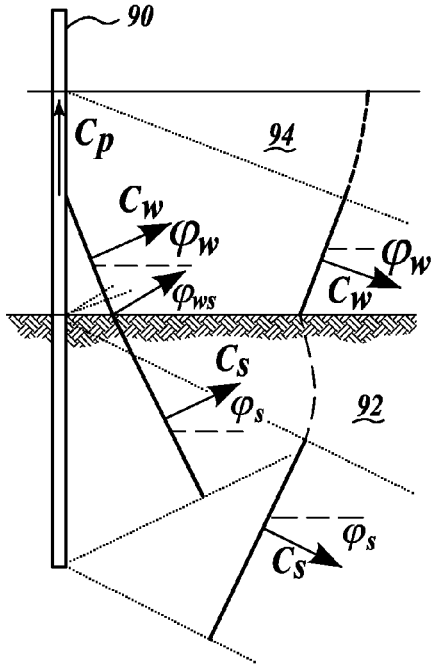
Figure 2:
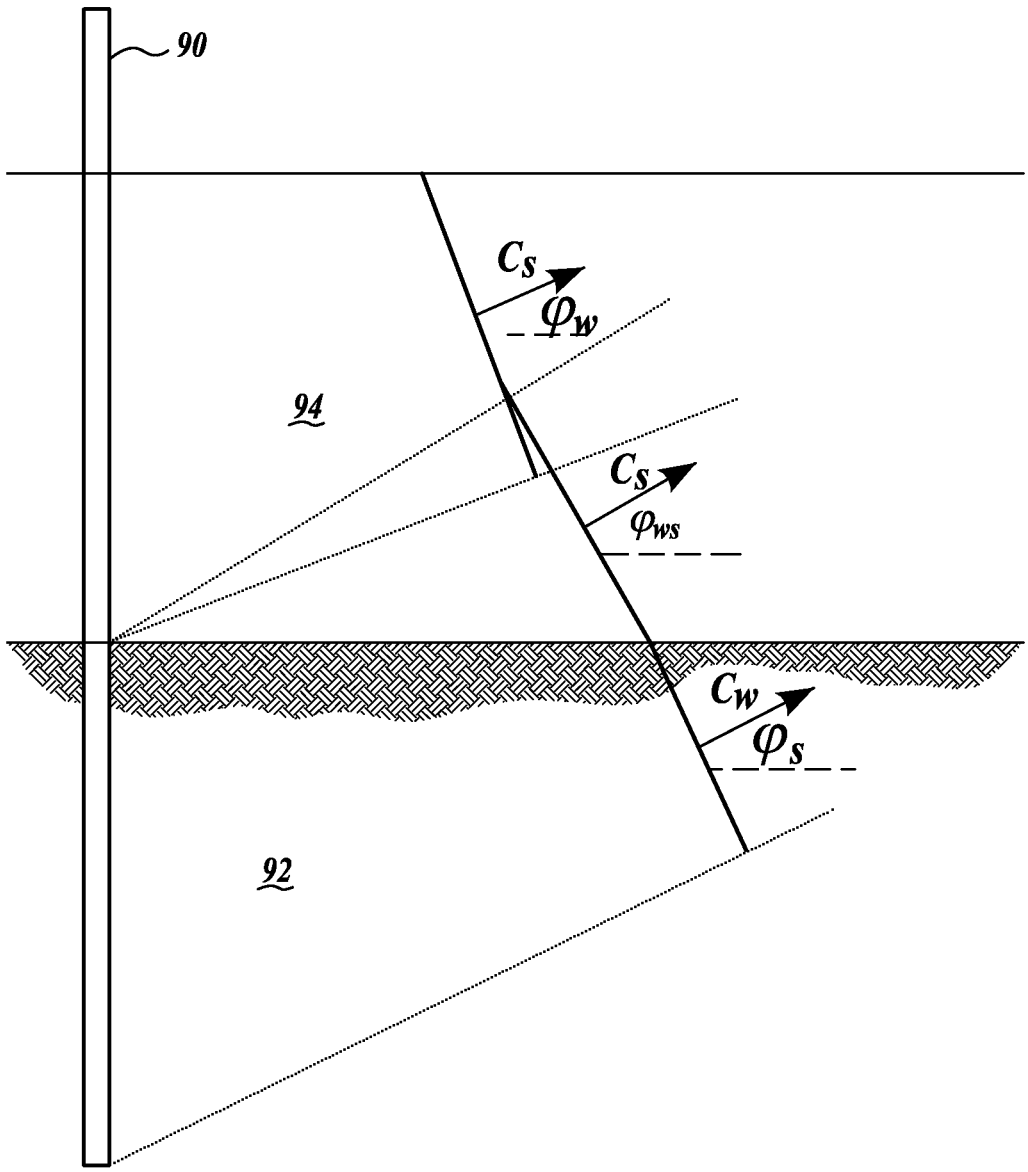
FIG. 2 illustrates only the first upwardly traveling wave front for the representative pile compression wave illustrated in FIGS. 1A-1D.

As the wave in the pile reaches the pile 100 terminal end it is reflected upwards (FIG. 1C). This upward traveling wave in turn produces a Mach cone of angle $\phi_s$ (defined as negative with respect to horizontal) that is traveling up instead of down. The sound field associated with this cone propagates up through the sediment 92 and penetrates into the water 94. Due to the change in the speed of sound going from sediment 92 to water 94 the angle of the wave front that originates in the sediment 92 changes from $\phi_s$ to $\phi_{sw}$=30.6° following Snell's law. Ultimately, two upward moving wave fronts occur as shown schematically in FIG. 1D and more clearly in FIG. 2. One wave front is oriented with angle $\phi_{sw}$ and the other wave front with angle $\phi_{ws}$. The latter is produced directly by the upward moving pile wave front in the water 94. (Other features of propagation such as diffraction and multiple reflections are not depicted in these schematic illustrations, for clarity.)

Based on finite element analyses performed to model the transient wave behavior generated from impacts generated when driving a steel pile, the generation of underwater noise during pile driving is believed to be due to a radial expansion wave that propagates along the pile after impact. This structural wave produces a Mach cone in the water and the sediment. An upwardly moving Mach cone produced in the sediment after the first reflection of the structural wave results in a wave front that is transmitted into the water. Repeated reflections of the structural wave causes upward and downward moving Mach cones in the water.

It is believed that prior art noise attenuation devices, such at bubble curtains and the TNAP discussed above, have limited effectiveness in attenuating sound levels transmitted into the water because these prior art devices do not address sound transmission through the sediment. As illustrated most clearly in FIG. 2, an upwardly traveling wave front propagates through the sediment 92 with a sound speed $c_w$. This wave front may enter the water outside of the enclosure defined by any temporary barrier, such as a bubble curtain or TNAP system, for example, such that the temporary barrier will have little effect on this component of the sound.

Figure 3:
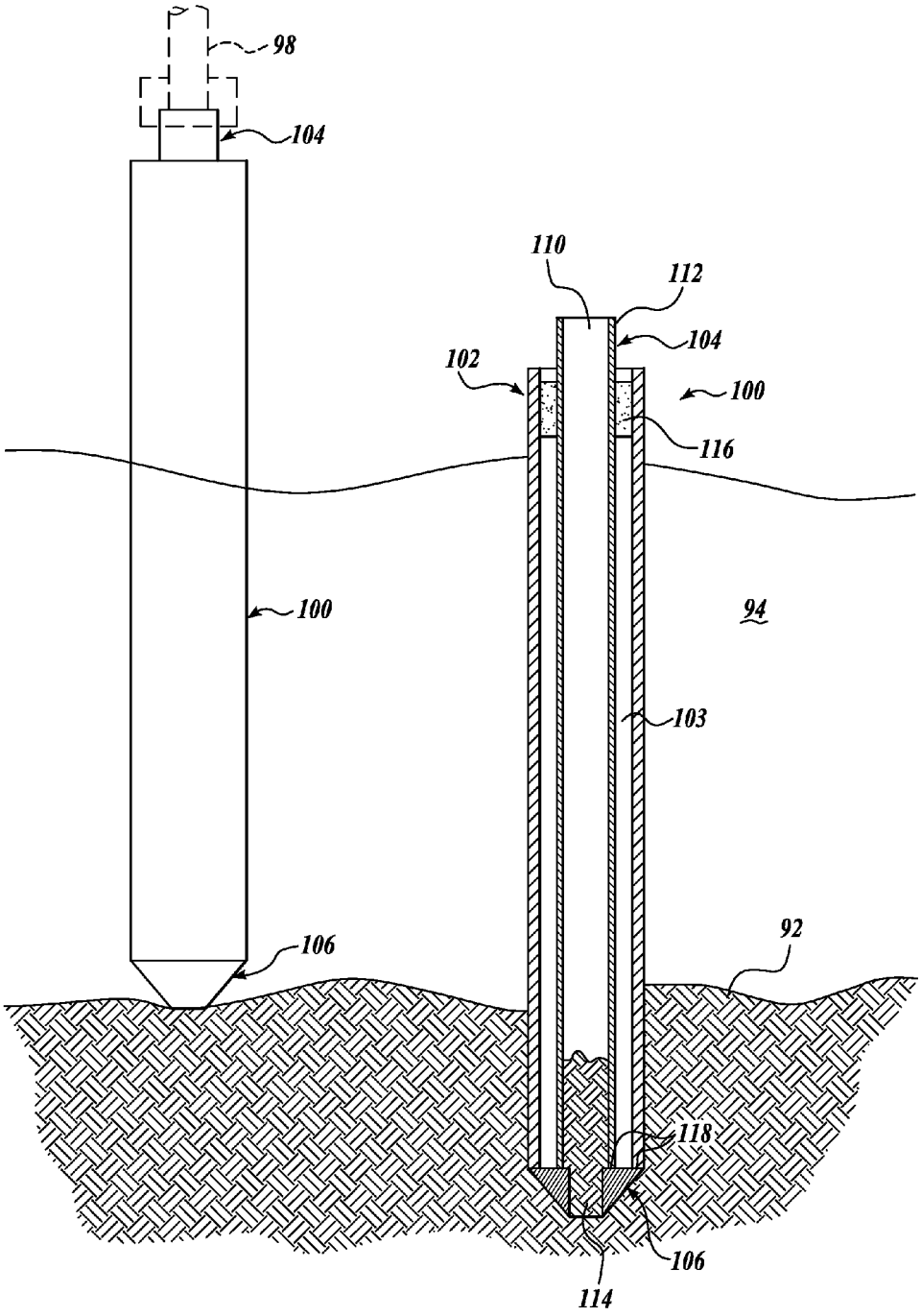
FIG. 3 illustrates two piles in accordance with the present invention, wherein one pile (on the left) is in position to be driven into an installed position, and the other pile (on the right) is shown installed and in cross section.

FIG. 3 illustrates a pair of noise-attenuating piles 100 in accordance with the present invention. In FIG. 3, the noise-attenuating pile 100 on the left is shown in position to be driven into the desired position with a pile driver 90, which is schematically indicated in phantom at the top of the pile 100. The identical noise-attenuating pile 100 on the right in FIG. 3 is shown in cross section, and installed in the sediment 92.

The noise-attenuating pile 100 includes a structural outer tube 102, a generally concentric inner tube 104, and a tapered driving shoe 106. In a current embodiment the outer tube 102 is sized and configured to accommodate the particular structural application for the pile 100, e.g., to correspond to a conventional pile. In one exemplary embodiment the outer tube 102 is a steel pipe approximately 89 feet long and having an outside diameter of 36 inches and a one-inch thick wall. Of course, other dimensions and/or materials may be used and are contemplated by the present invention. The optimal size, material, and shape of the outer tube 102 will depend on the particular application. For example, hollow concrete piles are known in the art, and piles having non-circular cross-sectional shapes are known. As discussed in more detail below, the outer tube 102 is not impacted directly by the driving hammer 90, and is pulled into the sediment 92 rather than being driven directly into the sediment. This aspect of the noise-attenuating pile 100 will facilitate the use of non-steel structural materials for the outer tube 102 such as reinforced concrete.

The inner tube 104 is generally concentric with the outer tube 102 and is sized to provide an annular space 103 between the outer tube 102 and the inner tube 104. The inner tube 104 may be formed from a material similar to the inner tube 104, for example, steel, or may be made of another material such as concrete. For example, the inner tube 104 may be concrete. It is also contemplated that the inner tube 104 may be formed as a solid elongate rod rather than tubular. In a particular embodiment, the inner tube 104 comprises a steel pipe having an outside diameter of 24 inches and a ⅜-inch wall thickness, and the annular space 103 is about six inches thick.

In a particular embodiment the outer tube 102 and the inner tube 104 are both formed of steel. The outer tube 102 is the primary structural element for the pile 100, and therefore the outer tube 102 is thicker than the inner tube. The inner tube is structurally designed to transmit the impact loads from the driving hammer 90 to the driving shoe 106.

The driving shoe 106 in this embodiment is a tapered annular member having a center aperture 114. The driving shoe 106 has a wedge-shaped cross section, tapering to a distal end defining a circular edge, to facilitate driving the pile 100 into the sediment 92. In a current embodiment the driving shoe 106 is steel. The outer tube 102 and inner tube 104 are fixed to the proximal end of the driving shoe 106, for example, by welding 118 or the like. Other attachment mechanisms may alternatively be used; for example, the driving shoe 106 may be provided with a tubular post portion that extends into the inner tube 104 to provide a friction fit. The driving shoe 106 maximum outside diameter is approximately equal to the outside diameter of the outer tube 102, and the center aperture 114 is preferably slightly smaller than the diameter of the axial channel 110 defined by the inner tube 104. It will be appreciated that the center aperture 114 permits sediment to enter into the inner tube 104 when the pile 100 is driven into the sediment 92. The slightly smaller diameter of the driving shoe center aperture 114 will facilitate sediment entering the inner tube 104 by reducing wall friction effects within the inner tube 104.

It will be appreciated from FIG. 3 that the inner tube 104 is longer than the outer tube 102, such that a portion 112 of the inner tube 104 extends upwardly beyond the outer tube 102. This configuration facilitates the pile driver 90 engaging and impacting only the inner tube 104. It is contemplated that other means may be used to enable the driver to impact the inner tube 104 without impacting the outer tube 102. For example, the pile driver 90 may be formed with an engagement end or an adaptor that fits within the outer tube 102. The important aspect is that the pile 100 is configured such that the pile driver 90 does not impact the outer tube 102, but rather impacts only the inner tube 104.

At or near the upper end of the pile 100, a compliant member 116, for example, an epoxy or elastomeric annular sleeve may optionally be provided in the annular space 103 between the inner tube 104 and the outer tube 102. The compliant member 116 helps to maintain alignment between the tubes 102, 104, and may also provide an upper seal to the annular space 103. Although it is currently contemplated that the annular space 103 will be substantially air-filled, it is contemplated that a filler material may be provided in the annular space 103, for example, a spray-in foam or the like. The filler material may be desirable to prevent significant water from accumulating in the annular space 103, and/or may facilitate dampening the compression waves that travel through the inner tube 104 during installation of the pile 100.

The advantages of the construction of the pile 100 can now be appreciated with reference to the preceding analysis. As the inner tube 104 is impacted by the driver 90, a deformation wave propagates down the length of the inner tube 104, and is reflected when it reaches the driving shoe 106, to propagate back up the inner tube 104, as discussed above. The outer tube 102 portion of the pile 100 substantially isolates both the surrounding water 94 and the surrounding sediment 92 from the traveling Mach wave, thereby mitigating sound propagation into the environment. The outer tube 102, which in this embodiment is the primary structural member for the pile 100, is therefore pulled into the sediment by the driving shoe 106, rather than being driven into the sediment through driving hammer impacts on its upper end.

Figure 4:
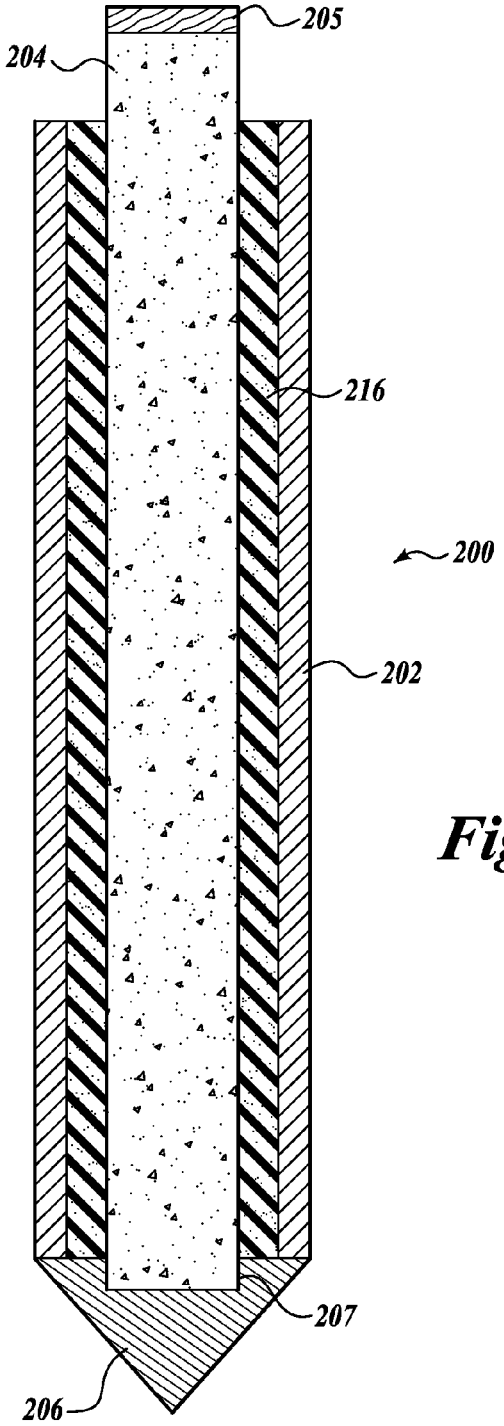
FIG. 4 shows another embodiment of a pile in accordance with the present invention.

A second embodiment of a noise-attenuating pile 200 in accordance with the present invention is shown in cross-sectional view in FIG. 4. In this embodiment the pile 200 includes an outer tube 202, which may be substantially the same as the outer tube 102 discussed above. A solid inner member 204 extends generally concentrically with the outer tube 202, and is formed from concrete. The inner member 204 may have a hexagonal horizontal cross section, for example. A tapered driving shoe 206 is disposed at the distal end of the pile 200, and is conical or frustoconical in shape, and may include a recess 207 that receives the inner member 204. In a currently preferred embodiment the driving shoe 206 is made of steel. The outer tube 202 is attached to the driving shoe 206, for example, by welding or the like. A center recess may be provided in the driving shoe 206 that is shaped and sized to receive the concrete inner member 204. The inner member 204 in this embodiment extends above the proximal end of the outer tube 204. Although not a part of the pile 200, a wooden panel 205 is illustrated at the top of the inner member 204, which spreads the impact loads from the pile driver, to protect the concrete inner member 204 from crumbling during the driving process. Optionally, in this embodiment a filler 216 such as a polymeric foam substantially fills the annular volume between the outer tube 202 and the inner member 204.

It is contemplated that in an alternate similar embodiment, an outer tube may be formed of concrete, and an inner tube or solid member may be formed from steel or a similarly suitable material.

Figure 5:
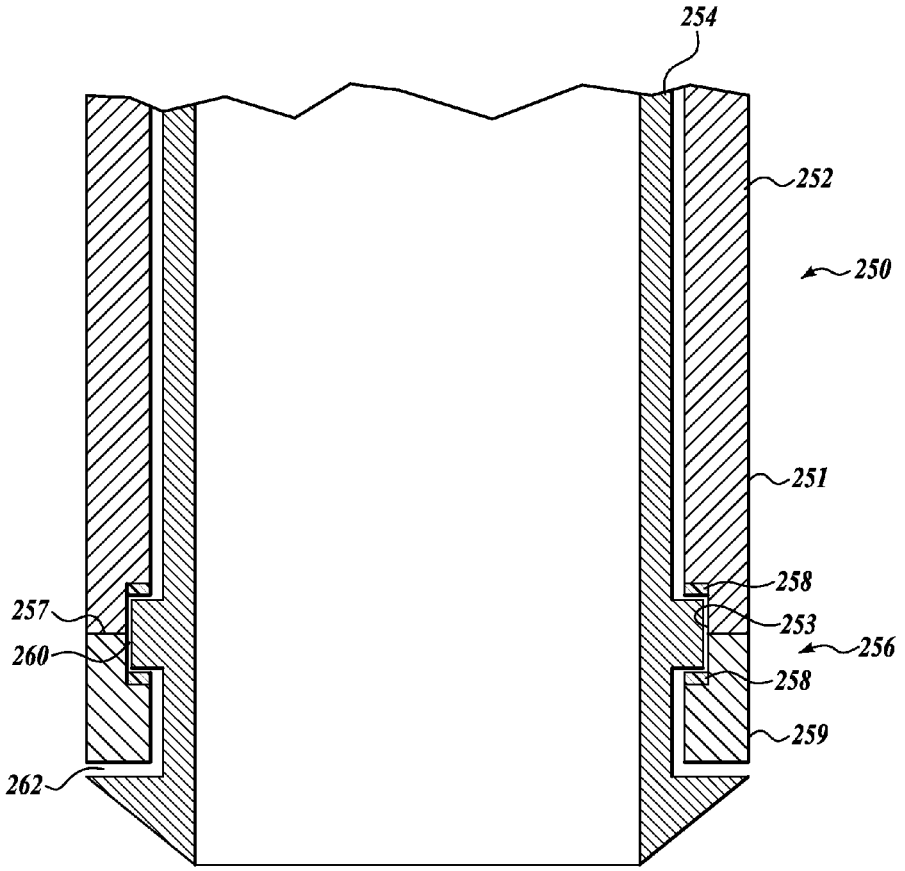
FIG. 5 shows a fragmentary view of the distal end an embodiment of a pile in accordance with the present invention.

FIG. 5 shows a cross-sectional view of an alternative embodiment of a pile 250 having an inner tube 254 and an outer tube 252. The pile 250 is similar to the pile 100 disclosed above, but wherein the driver shoe 256 is formed integrally with the inner and outer tubes 254, 252. In this embodiment, the distal end portion of the inner tube 254 includes an outer projection or flange 251. For example, the flange 255 may be formed separately and welded or otherwise affixed to the distal end portion of the inner tube 254. The outer tube 252 is configured with a corresponding annular recess 253 on an inner surface, which is sized and positioned to retain or engage the flange 255. In an exemplary construction method the outer tube 252 is formed from two pieces, an elongate upper piece 251 having an inner circumferential groove on its bottom end, and a distal piece 251' having a corresponding inner circumferential groove on its upper end. The distal piece 251' may further be formed in two segments to facilitate placement about the inner tube 254. The upper piece 251 and distal piece 251' may then be positioned about the inner tube 254 such that the flange 255 is captured in the annular recess 253, and the upper piece 251 and distal piece 251' welded 257 or otherwise fixed together. The inner tube 254 and outer tube 252 are therefore interlocked by the engagement of the inner tube flange 255 and the outer tube annular recess 253. One or two low-friction members 258 (two shown), for example nylon washers, may optionally be provided.

In the embodiment of FIG. 5, the flange 255 is sized such that a gap 260 is formed between an outer surface of the flange 255 and an inner surface of the annular recess 253. Also, the length of the outer tube 252 is configured to provide a gap 262 between the bottom of the outer tube 253, and the horizontal surface of the shoe 256 near the distal end of the inner tube 254. It will now be appreciated that as the radial displacement waves induced by the pile driver travel along the inner tube 254 the outer tube 252 will be further isolated from the radial displacement waves due to these gaps 260, 262.

Figure 6:
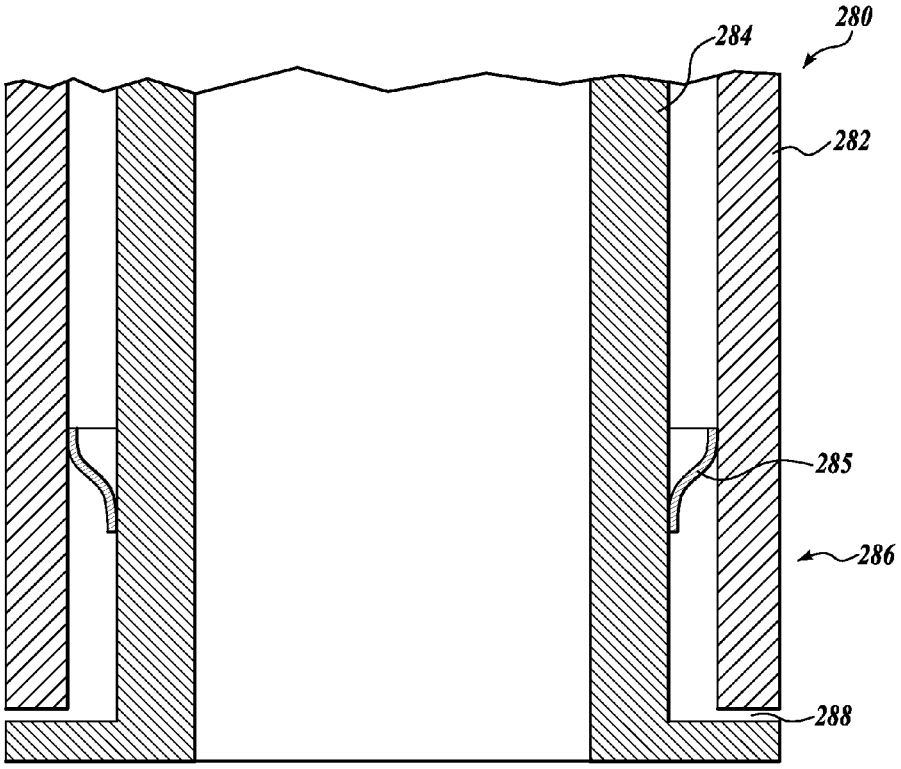
FIG. 6 illustrates an embodiment with an elastic connection mechanism that may alternatively be used to isolate the outer tube from the inner member.

Although a flange and recess connection is shown in FIG. 5, it is also contemplated, as illustrated in FIG. 6, that a pile 280 in accordance with the present invention may include an elastic or compliant connector 285 may alternatively be provided between the inner tube 284 and the outer tube 282 of the pile 280. It is contemplated, for example, that the elastic connector 285 connecting the inner tube and outer tube may be an annular linear elastic spring member with an inner edge fixed to the inner tube 284, and an outer edge fixed to the outer tube 282. In this embodiment the driving shoe 286 is formed integrally with the inner and outer tubes 284, 282, and the elastic connector 285 substantially isolates the outer tube 282 from the radial compression waves induced in the inner tube 284 by the driver.

Although the piles 100, 200 are shown in a vertical orientation, it will be apparent to persons of skill in the art, and is contemplated by the present invention, that the piles 100, 200 may alternatively be driven into sediment at an angle.

While illustrative embodiments have been illustrated and described, it will be appreciated that various changes can be made therein without departing from the spirit and scope of the invention.

The embodiments of the invention in which an exclusive property or privilege is claimed are defined as follows:

1. A pile configured for noise abatement during installation comprising:

a driving shoe;

an inner member having a proximal end attached to the driving shoe and a distal end that extends upwardly from the driving shoe;

an outer tube surrounding the inner member such that an annular space is defined between the inner tube and the outer tube and having a proximal end attached to the driving shoe and a distal end that extends upwardly from the driving shoe;

wherein the pile is configured such that a pile driver impacts the inner member without impacting the outer tube, and further wherein the distal end of the outer tube is not rigidly connected to the distal end of the inner member, and further wherein the annular space is substantially filled with a compressible material.

2. The pile of claim 1, wherein the inner member comprises a steel tube.

3. The pile of claim 1, wherein the inner member comprises an elongate concrete structure.

4. The pile of claim 3, wherein the elongate concrete structure comprises a solid rod.

5. The pile of claim 1, wherein the distal end of the inner member extends above the distal end of the outer tube.

6. The pile of claim 1, wherein the inner member defines an axial channel having a first diameter, and further wherein the driving shoe further comprises an axial aperture aligned with the channel, wherein the axial aperture has a diameter that is less than the first diameter.

7. The pile of claim 1, further comprising a compliant annular material disposed in an annular space between the inner member and the outer tube and located near the distal end of the outer tube.

8. The pile of claim 7, wherein the compliant material comprises a polymeric material, and further wherein the compliant material seals an annular region between the outer tube and the inner member.

9. The pile of claim 1, the driving shoe is formed integrally with the inner member and the outer tube.

10. The pile of claim 1, wherein the inner member further comprises an outer flange and the outer tube further comprises an annular recess that is configured to capture the outer flange of the inner member.

11. The pile of claim 1, wherein the inner member is attached to the outer tube with an annular elastic spring member.

12. The pile of claim 1, wherein the driving shoe defines a recess that is sized and shaped to receive the inner member.

13. A method for driving piles into a seabed comprising:

providing a pile comprising a driving shoe, an inner member having a proximal end that is attached to the driving shoe and a distal end that extends upwardly from the driving shoe, and an outer tube surrounding the inner member such that an annular space is defined between the inner member and the outer tube, the outer tube having a proximal end that is attached to the driving shoe and a distal end that extends upwardly from the driving shoe, and wherein the distal end of the outer tube is not rigidly connected to the distal end of the inner member, and further wherein the annular space is substantially filled with a compressible material;

positioning the pile at a desired position with the driving shoe contacting the seabed; and driving the pile with a pile driver such that the pile driver impacts the inner member without impacting the outer tube such that the outer tube is configured to be pulled into the seabed by the driving shoe.

14. The method of claim 13, wherein the inner member comprises a steel tube.

15. The method of claim 13, wherein the inner member comprises an elongate concrete structure.

16. The method of claim 15, wherein the elongate concrete inner member comprises a solid rod.

17. The method of claim 13, wherein the distal end of the inner member extends above the distal end of the outer tube.

18. The method of claim 13, wherein the inner member defines an axial channel having a first diameter, and further wherein the driving shoe further comprises an axial aperture aligned with the channel, wherein the axial aperture has a diameter that is less than the first diameter.

19. The method of claim 13, further comprising a compliant annular material disposed in an annular space between the inner member and the outer tube and located near the distal end of the outer tube.

20. The method of claim 19, wherein the compliant material comprises a polymeric material, and further wherein the compliant material seals an annular region between the outer tube and the inner member.

21. The method of claim 13, the driving shoe has a maximum diameter that is equal to an outside diameter of the outer tube.

22. The method of claim 13, further comprising an elastomeric foam disposed between the outer tube and the inner member.

23. The method of claim 13, wherein the driving shoe defines a recess that is sized and shaped to receive the inner member.

* * * * *

UNITED STATES PATENT AND TRADEMARK OFFICE

CERTIFICATE OF CORRECTION

PATENT NO. : 8,622,658 B2
APPLICATION NO. : 13/574231
DATED : January 7, 2014
INVENTOR(S) : P. G. Reinhall et al.

It is certified that error appears in the above-identified patent and that said Letters Patent is hereby corrected as shown below:

In the Claims

| COLUMN | LINE | ERROR |
|---|---|---|
| 8 (Claim 9, line 1) | 38 | after "claim 1," insert --wherein-- |
| 9 (Claim 21, line 1) | 22 | after "claim 1," insert --wherein-- |

Signed and Sealed this
Seventeenth Day of June, 2014

Michelle K. Lee

Michelle K. Lee
*Deputy Director of the United States Patent and Trademark Office*